US007905076B2

(12) United States Patent
Rozenfeld et al.

(10) Patent No.: US 7,905,076 B2
(45) Date of Patent: Mar. 15, 2011

(54) APPARATUS AND METHOD FOR CONVEYING ENVELOPES IN A MAILPIECE INSERTION SYSTEM

(75) Inventors: Boris Rozenfeld, New Milford, CT (US); Anthony E. Yap, Southington, CT (US); William J. Wright, Killingworth, CT (US); Arthur H. Depoi, Brookfield, CT (US); John R. Masotta, Bethel, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 162 days.

(21) Appl. No.: 12/274,718

(22) Filed: Nov. 20, 2008

(65) Prior Publication Data

US 2010/0122514 A1 May 20, 2010

(51) Int. Cl.
*B43M 3/04* (2006.01)
*B43M 3/00* (2006.01)

(52) U.S. Cl. ..... 53/473; 53/250; 270/58.06; 271/2

(58) Field of Classification Search ..... 53/460, 53/467, 468, 473, 492, 569, 284.3, 249, 250, 53/381.5, 381.7; 270/58.06; 271/2; *B41M 3/00, B41M 3/02, 3/04*

See application file for complete search history.

(56) References Cited

U.S. PATENT DOCUMENTS

| | | | | |
|---|---|---|---|---|
| 4,924,652 | A * | 5/1990 | Krasuski et al. | 53/569 |
| 5,220,770 | A * | 6/1993 | Szewczyk et al. | 53/284.3 |
| 5,408,811 | A * | 4/1995 | Satake | 53/569 |
| 5,428,944 | A | 7/1995 | Belec et al. | |
| 5,924,265 | A | 7/1999 | Auerbach | |
| 6,494,019 | B1 * | 12/2002 | Lingle | 53/284.3 |
| 2004/0080099 | A1 | 4/2004 | Janatka et al. | |
| 2004/0123571 | A1 | 7/2004 | Rozenfeld | |

FOREIGN PATENT DOCUMENTS

| | | | |
|---|---|---|---|
| EP | 597437 | A1 * | 5/1994 |
| JP | 63307002 | A * | 12/1988 |
| JP | 04201298 | A * | 7/1992 |
| JP | 07047796 | A * | 2/1995 |
| JP | 07061183 | A * | 3/1995 |
| JP | 2001180157 | A * | 7/2001 |

* cited by examiner

*Primary Examiner* — Stephen F Gerrity
(74) *Attorney, Agent, or Firm* — Brian A. Collins; Steven Shapiro; Charles R. Malandra, Jr.

(57) ABSTRACT

An apparatus includes a first feed path configured to transport an envelope from an input at an envelope supply to an insertion location, and a second feed path configured to transport the envelope with a mail piece insert therein from the insertion location to an output. The first and second feed paths intersect at an intersection spaced from the insertion location. The paths are angled relative to each other at the intersection.

14 Claims, 6 Drawing Sheets

APPARATUS AND METHOD FOR CONVEYING ENVELOPES IN A MAILPIECE INSERTION SYSTEM

FIELD OF THE INVENTION

The invention relates to an envelope transport and, more particularly, to the feeding of envelopes to a mail piece insertion location.

BACKGROUND OF THE INVENTION

Inserter machines are used to create mail pieces for many different applications. Inserters contain a generally modular array of components to carry out the various processes associated with mail piece creation. The processes include preparing documents, assembling the documents associated with a given mail piece, adding any designated inserts, stuffing the assembly into an envelope in the envelope insertion engine, and printing information on the envelope.

In the inserter industry, there are generally two arrangements utilized for the envelope insertion engine: "flap-up" insertion and "flap-down" insertion. Flap-up insertion refers to an envelope orientation in which the flap of the open envelope is located above the prepared collation, which is substantially horizontal during the insertion of the collation into the envelope. The geometry of some flap-up insertion engines allows the envelope hopper to be located on the operator side of the machine without introducing the complexity and reduced reliability of a right angle turn. In other words, the envelope path from the envelope hopper to the insertion location is substantially linear.

However, some flap-up inserter designs require additional steps in building the collation in order to place the address-bearing document on the top of the collation. The additional steps may reduce the operating reliability of those systems.

Flap-down insertion refers to an envelope orientation in which the open envelope is arranged in the insertion engine with its flap located underneath a prepared collation, which is substantially horizontal during the insertion of the collation into the envelope. In flap down inserting, the address-bearing document remains on the bottom while the collation is built. That arrangement may simplify the process of building the collation.

In some flap-down inserter designs, however, it is necessary to utilize a more complex feed path including a right angle turn, for example, in order to locate the envelope hopper on the operator side of the machine.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with one aspect of the invention, an apparatus is provided comprising a first feed path configured to transport an envelope from an input at an envelope supply to an insertion location and a second feed path configured to transport the envelope with a mail piece insert therein from the insertion location to an output. The first feed path and the second feed path may intersect at an intersection spaced from the insertion location.

In another aspect, the invention relates to an apparatus comprising an envelope supply, an insertion device configured to insert a mail piece insert into an envelope while the envelope is in a flap-down position in an insertion location, and a transportation system configured to transport the envelope from the envelope supply to the insertion location with a closed end of the envelope, which is located opposite a flap end of the envelope, as a forward leading edge of the envelope. The transportation system may comprise a first feed path from the envelope supply to the insertion location and a second feed path from the insertion location to an output. The first feed path and the second feed path may intersect at an intersection spaced from the insertion location.

In yet another aspect, the invention relates to a method comprising transporting an envelope along a first feed path from an input to an insertion location and transporting the envelope, with a mail piece insert therein, along a second feed path from the insertion location to an output. The first feed path and the second feed path may intersect at an intersection spaced from the insertion location.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Envelope insertion stations are important subsystems of document inserting systems. An envelope insertion device typically inserts collated enclosures into a waiting envelope. The envelope insertion device may be used with enclosures of varying thickness and with enclosures that are not significantly different in length than the length of the envelopes into which they are inserted.

Some envelope insertion stations use continuously running transport belts on the deck of the insertion station, wherein the transport belts feed the envelope. Once the envelope is at an insertion position, a stop is used prevent the envelope from continuing with the belt. In one example, the transport belt slides along the underside of the envelope while the envelope is stopped by the stop.

Figure 1:
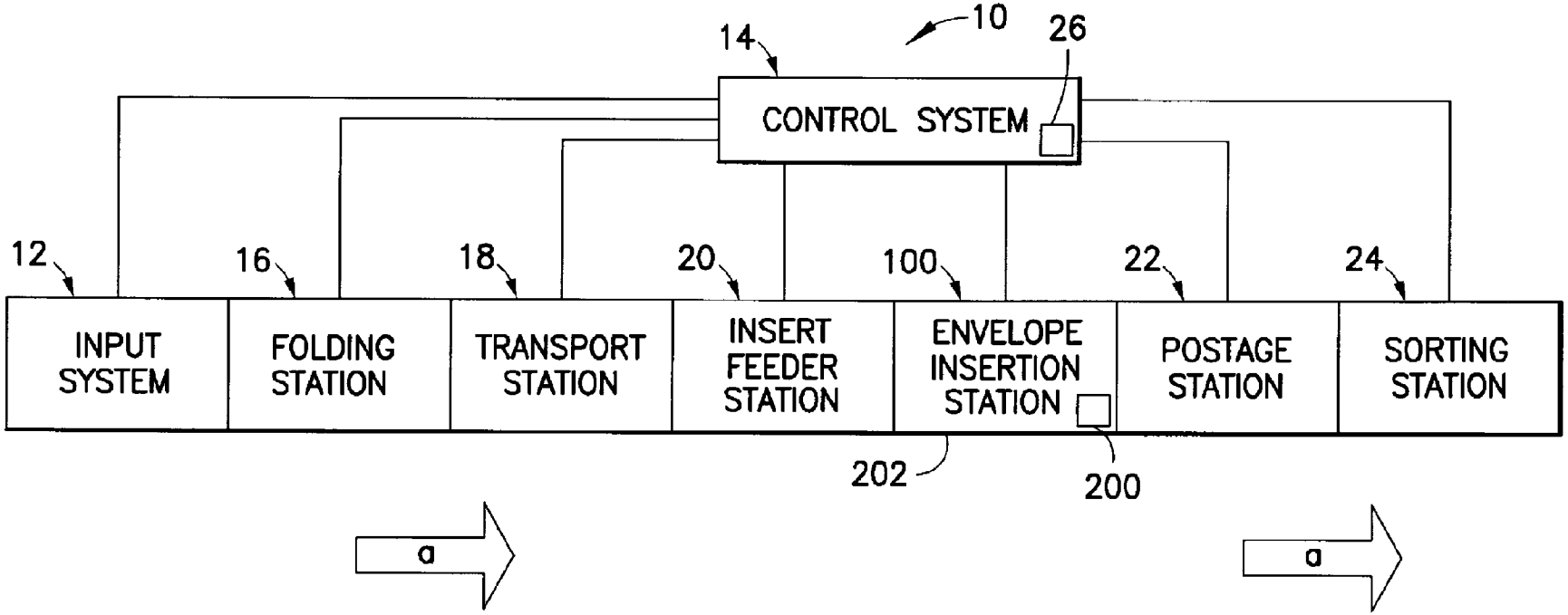
FIG. 1 is a block diagram schematic of a document inserting system having an envelope insertion station according to one illustrative embodiment of the invention.

Referring to FIG. 1, there is shown a schematic block diagram of a document inserting system 10 incorporating features of the invention. Although the invention will be described with reference to exemplary embodiments shown in the drawings, it should be understood that the invention may be embodied in many alternate forms of embodiments. In addition, any suitable size, shape or type of elements or materials may be used. The document inserting system 10 shown in FIG. 1 includes an insertion station 100. The document inserting system 10 is illustrative and many other configurations may be utilized.

The system 10 includes an input system 12 that feeds paper sheets from a paper web to an accumulating station that accumulates the sheets of paper in collation packets. In one example, only a single sheet of a collation (e.g., the control document) is coded. The coded information enables the control system 14 of the inserter system 10 to control the processing of documents in the various stations of the mass mailing inserter system.

The input system 12 feeds sheets in a paper path, as indicated by arrow "a", along what is known as the main deck of the inserter system 10. After sheets are accumulated into collations by the input system 12, the collations are folded in a folding station 16. The folded collations are then conveyed to a transport station 18. In one example, the transport station 18 is operative to perform buffering operations for maintaining a proper timing scheme for the processing of documents in the insertion system 10.

Each sheet collation is fed from the transport station 18 to the insert feeder station 20. It is to be appreciated that an inserter system 10 may include a plurality of feeder stations, but for clarity, only a single insert feeder 20 is shown in FIG. 1.

The insert feeder station 20 is operational to convey an insert (e.g., an advertisement) from a supply tray to the main deck of inserter system 10 to be combined with the sheet collation conveying along the main deck. The sheet collation, along with the nested insert(s), are next conveyed into the envelope insertion station 100 that is operative to first open the envelope and then to insert the collation into the opening of the envelope. The envelope is then conveyed to a postage station 22. Finally, the envelope is conveyed to a sorting station 24 that sorts the envelopes in accordance with postal discount requirements.

Figure 2:
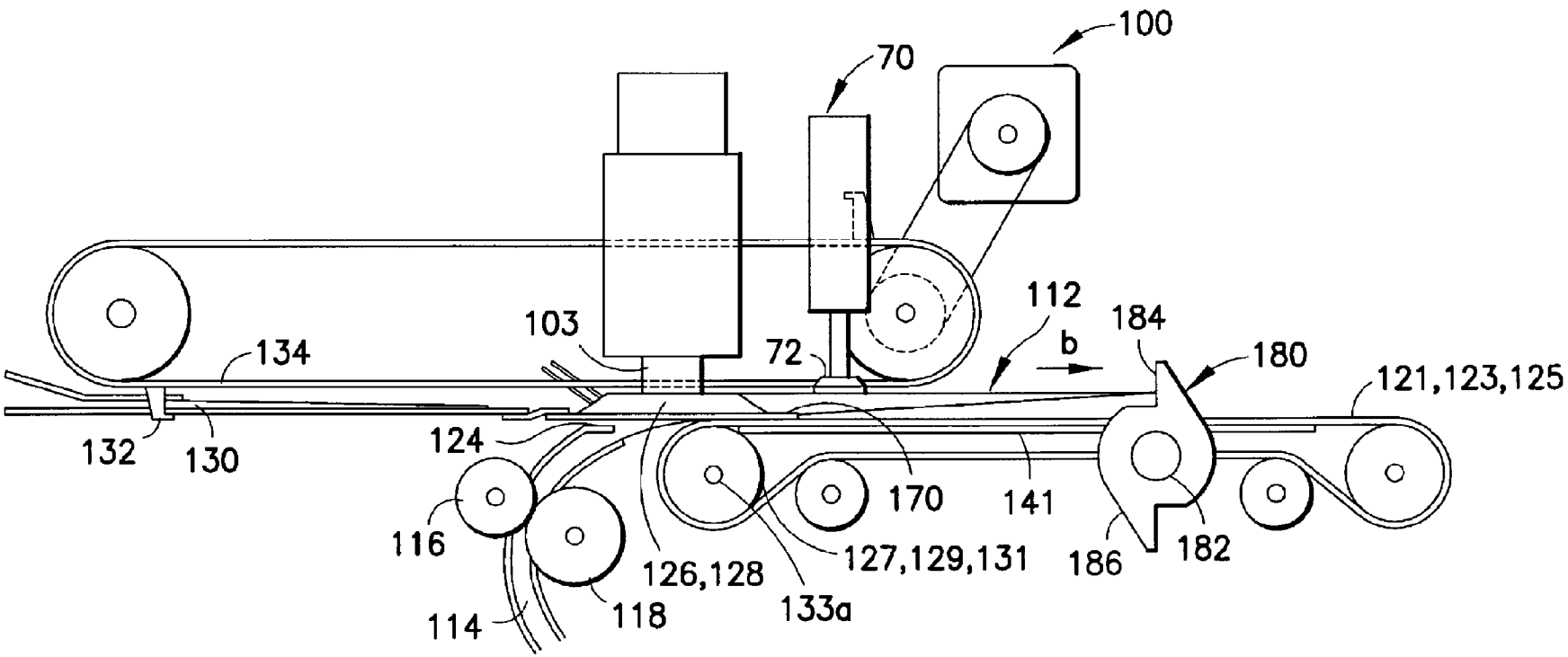
FIG. 2 is a side elevational view of the document inserter of the envelope insertion station shown in FIG. 1.

Referring now to FIG. 2, the envelope insertion station 100 according to an illustrative embodiment is shown. In operation, an envelope enters the insertion station 100 along a guide path 114 and is transported into the insertion station 100 by a set of transport rollers 116, 118 and continuously running transport belts 121, 123, 125. Each transport belt 121, 123, 125, respectively, wraps around rollers 127, 129, 131, each roller being connected to a common shaft 133*a*. Each transport belt 121, 123, 125 is juxtaposed between deck strips that form the transport deck 141 of the insertion station 100.

The motion of each transport belt 121, 123, 125 is continuous for maintaining registration of an envelope 112 against a backstop 180. Continuous vacuum from each of the deck strips via their respective vacuum plenums prevents undesirable motion of the envelope due to the transport belts 121, 123, 125 continuously running beneath.

In one embodiment, rotating backstop members 180 are located outside the vacuum deck strips in an elongate slot. Each backstop member 180 is concentrically mounted about a common shaft 182 for effecting rotation thereof. Each stopping portion 184 is configured to stop an envelope when it is above the deck 141 of the insertion station 100. A servo motor (not shown) causes rotation of the backstop members 180 about an axle 182. Other arrangements may also be used.

The insertion station 100 includes envelope flap retainers 124 and rotating insertion horns 126, 128, each having an underside that helps to conform an envelope to each transport belt 121, 123, 125, while not presenting any catch points for the leading edge of the enclosure collation 130 to be inserted in a waiting open envelope 112.

The horns 126, 128 are supported from above the envelope path and are eccentrically mounted on pivot shafts 103. They are positioned perpendicular to the path of the envelope travel as the envelope is conveyed to backstop members 180. In some embodiments, discussed below, a vacuum assembly is used to open the envelope during insertion of the collation. Once the vacuum assembly 70 has begun to open the envelope, the insertion horns 126, 128 pivot into the envelope and continue their pivoting motion until the extreme edges of the envelope have been shaped and supported by the profile of each horn 126 and 128.

Rotating insertion horns 126, 128 perform the additional function of centering the envelope 112 in the path of the oncoming enclosure collation 130. At this time an oncoming enclosure collation 130 may be introduced and pushed through the insertion horns 126, 128 into a waiting envelope 112. In one embodiment, the pivot shaft of each insertion horn 126, 128 is driven by a servo motor (not shown). Other arrangements may also be used.

The insertion station 100 further includes an envelope opening vacuum assembly 70 for separating the back panel of an envelope from its front panel. The vacuum assembly 70 is perpendicular to the transport deck 141 of the insertion station 100. The vacuum assembly 70 includes a reciprocating vacuum cup 72 that translates vertically downward toward the surface of the transport deck 141 and then upward away from the transport deck 141 to a height sufficient to allow a stuffed envelope to pass under it. The vacuum cup 72 adheres to the back panel of an envelope through a vacuum force present in the vacuum cup 72, so as to separate the envelope's back panel away from its front panel during the upward travel of the vacuum cup 72.

The enclosure collations 130 are fed into the insertion station 100 by means of a pair of overhead pusher fingers 132 extending from a pair of overhead belts 134 relative to the deck of the inserter system 10. As with the envelope 112, the top side of the envelope flap retainers 124 and the associated interior of the insertion horns 126, 128 must not present any catch points for the leading edge of the enclosure collation 130.

An envelope 112 is conveyed to the transport deck 141 of the insertion station 100 via guide path 114, which is in connection with an envelope supply. Once a portion of the envelope 112 contacts the continuous running transport belts 121, 123, 125, these transport belts convey the envelope 112 downstream, as indicated by arrow b, in the insertion station 100. Concurrently, each deck strip of the transport deck 141 provides a continuous vacuum force upon the envelope 112 via vacuum plenums, so as to force the envelope 112 against the continuous running transport belts 121, 123, 125.

Next, an elongate stopping portion 184 of the backstop member 180 is caused to extend above the transport deck 141 at a height sufficient to stop travel of the envelope 112 in the insertion station 100. The leading edge of the envelope 112 then abuts against the stopping portion 184 of the backstop member 180, so as to prevent further travel of the envelope 112.

While the envelope 112 is abutting against the stopping portion 184 of the backstop member 180, the transport belts 121, 123, 125 are continuously running beneath the envelope 112. The continuous vacuum force applied to the envelope 112 by the deck strips acts to stabilize the envelope 112 on the transport deck 141 while it is abutting against backstop member 180. The vacuum force, therefore, prevents undesirable motion of the envelope 112 caused by the friction of the continuously running transport belts 121, 123, 125.

When the envelope 112 is disposed in the insertion station 100, the vacuum cup 72 of the vacuum assembly 70 is caused to reciprocate downward towards the back panel of envelope 112. The vacuum cup 72 adheres to the back panel and then reciprocates upwards, so as to separate the back panel from the envelope front panel to create an open channel in the envelope 112. The enclosure collation 130 is then conveyed towards the envelope 112 by the pusher fingers 132.

At first, the insertion horns 126, 128 are positioned in a first position in which their respective stripper blade portions 170 are positioned outside of the open end of the closed envelope 112. Before the conveying enclosure collation 130 is advanced into the open channel of envelope 112, each insertion horn 126, 128 is pivoted approximately 65 degrees towards its second position. When pivoted, the insertion horns 126, 128 provide a guide path into the open channel of the envelope 112 through which an enclosure collation 130 travels into the envelope 112.

Figure 3:
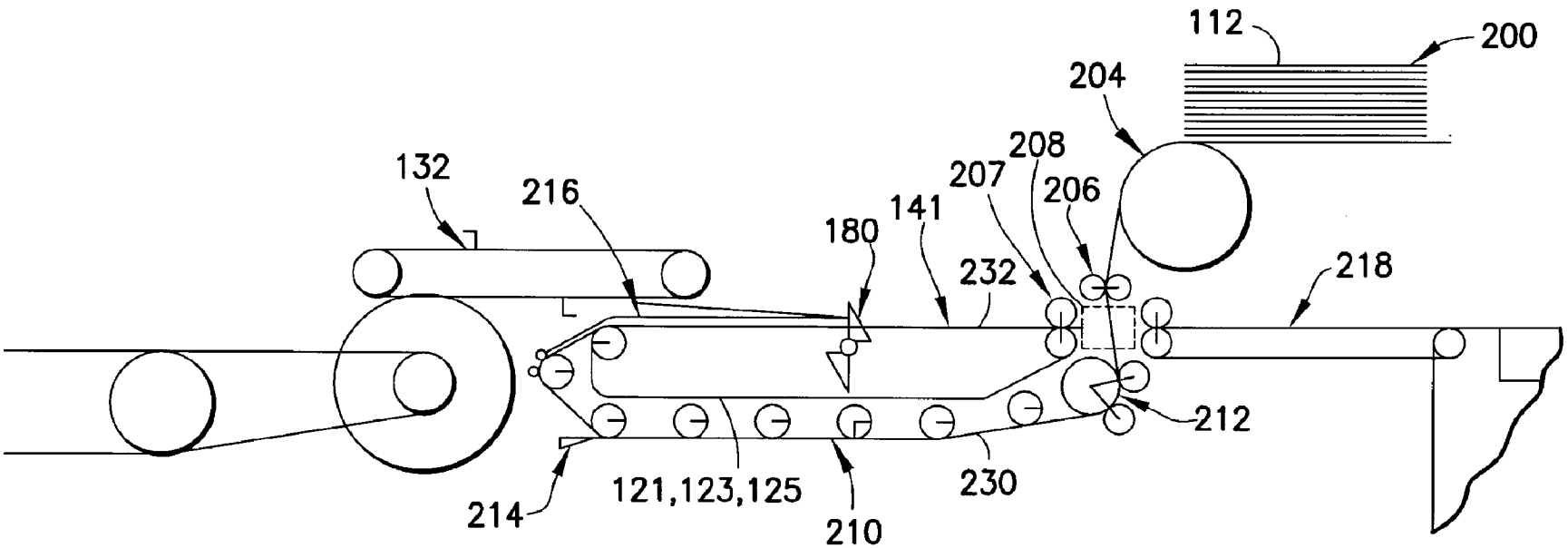
FIG. 3 is a side elevational view of the envelope insertion station shown in FIG. 1.

Referring also to FIG. 3, the invention may provide intersecting paper paths for a high speed inserter. In one embodiment, the invention comprises intersecting envelope paths and a controller to provide uninterrupted material flow of un-stuffed envelopes and stuffed envelopes through the intersection to a flap-down insertion location. The envelope hopper 200 may be located so as to be accessible to the operator and may provide a linear motion of the envelopes (i.e., no abrupt lateral or right-angle shifts in direction) down to the insertion deck. In some embodiments, the invention provides a flap-down inserter that includes many of the benefits of a flap-up inserter.

FIG. 3 illustrates the intersecting envelope paths and the surrounding geometry according to embodiments of the invention. The envelope hopper 200 contains a stack of envelopes 112 oriented face-up. The flaps of the envelopes are in a closed position in a flap-down and flap trailing orientation. Based on its location, as seen in FIG. 1, the envelope hopper 200 is accessible to the operator proximate to the open side 202. The hopper 200 is located vertically above the transport deck 141. The envelope path from the hopper 200 down to the deck 141 at the insertion station 100 provides a linear motion of the envelope (i.e., no abrupt right angle shifts in direction of the envelope from a first direction to an orthogonal second direction). In several conventional flap-down embodiments, the envelope hopper is located outboard (i.e., to the extreme right in FIG. 3) of the Mailing Output System (MOS), making envelope loading difficult or impossible to accomplish from the operator side 202.

Envelopes are fed by an envelope feeder from the hopper 200. The envelope feeder comprises an envelope separating device 204 and an envelope staging nip 206. Once an envelope is at rest and staged under the control of this nip 206, at the appropriate time the staging nip 206 accelerates the envelope vertically downward and through the paper path intersection zone 208 to be received by the envelope staging areas 210.

An envelope flap opening mechanism 212 is provided downstream of the intersection zone 208. Also located within the envelope staging area 210 is an envelope diverter 214, which is actuated to remove an envelope from the paper path in the event that that the envelope failed to open the flap at the envelope flap opener 212. After an envelope exits the envelope staging area 210, it enters the envelope insertion location 216 under the control of the vacuum deck 141 and comes to rest with its leading edge located at the rotary backstops 180.

Figure 4:
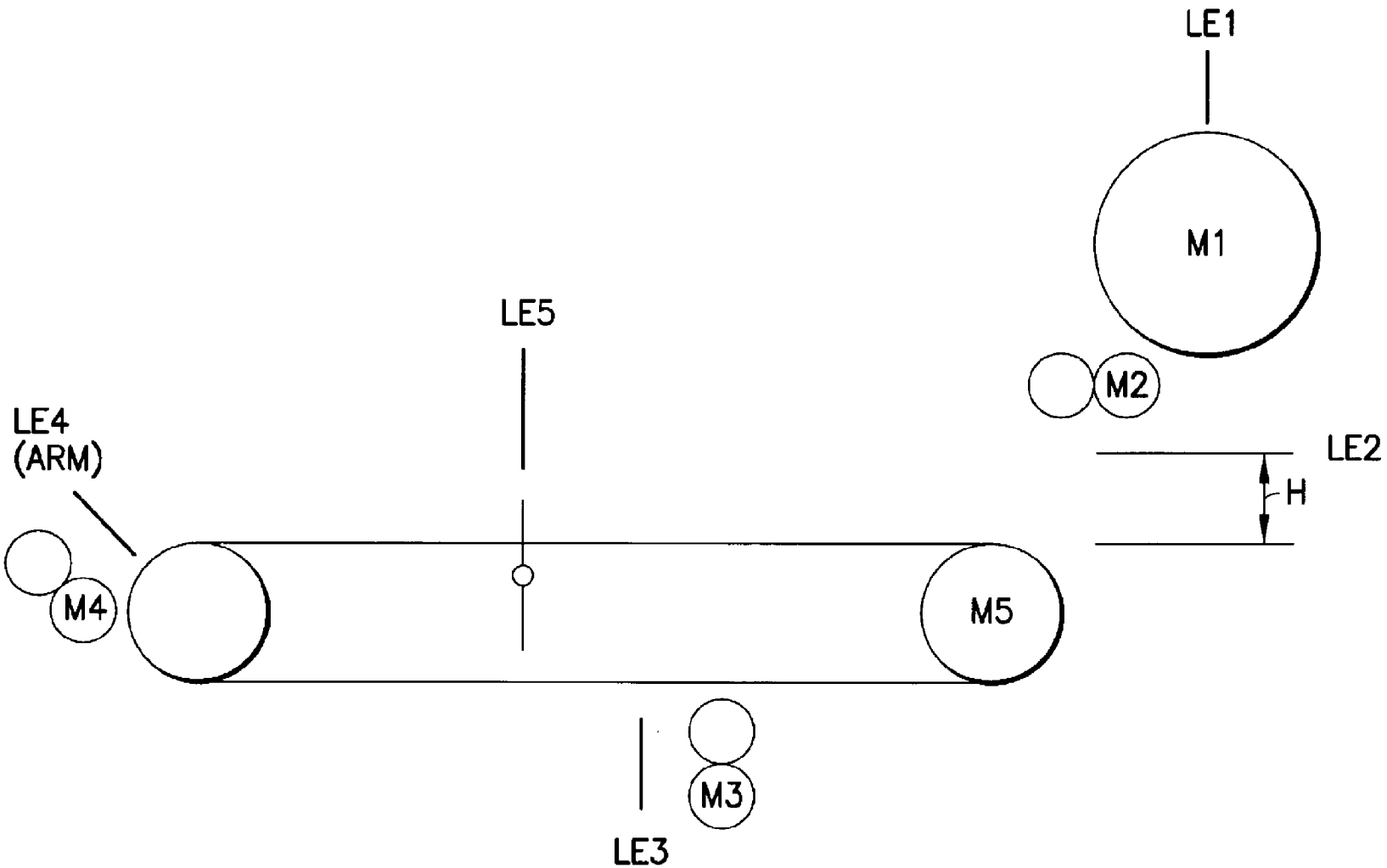
FIG. 4 is a partial schematic view of the envelope insertion station shown in FIG. 3 illustrating locations of leading edges of envelopes during travel through the envelope insertion station.

FIG. 4 illustrates diagrammatically the staging locations for leading edges (LE) of an envelope as it moves from the envelope hopper 200 to the insertion location 216 on the vacuum deck 141, also sometimes referred to as the insertion deck.

As shown in FIG. 4, LE 1 is the position of the leading edge of the bottom-most envelope in the envelope hopper 200. LE 2 is the position of the leading edge of the envelope at the envelope staging location proximate to the staging nip 206 upstream of the intersection zone 208. LE 3 is the position of the leading edge of the envelope at the envelope staging location 210 downstream from the intersection zone 208. LE 4 is the position of the leading edge of the envelope at the final envelope staging location (sometimes referred to as the arm position) before the envelope is delivered to the insertion deck 141. LE 5 is the position of the leading edge of the envelope at the location of the envelope during insertion, where the leading edge of the envelope is defined by the location of the rotary backstops 180.

FIG. 4 illustrates the five staging positions for a small depth envelope. Small depth envelopes are defined herein as envelopes having a depth of approximately 6.5 inches or less. Such envelopes typically accommodate tri-fold and half-fold applications. For small depth envelopes, the staging area 210 normally contains two envelopes.

Larger depth envelopes are defined as envelopes having a depth greater than approximately 6.5 inches. Those envelopes typically accommodate flats applications. For larger depth envelopes, the staging area 210 normally contains only one envelope, and the staging position shown in FIG. 4 as LE 3 is eliminated. However, features of the invention may be used with envelopes having any suitable size.

The envelope staging nip 206 and the staging area 210 may be driven by a single servo motor or a plurality of motors (M2, M3, M4), as shown in FIG. 4, to provide a rapid incremental start/stop motion to transfer envelopes from stage to stage within one insertion cycle. Once an envelope is stuffed on the vacuum deck 141, its departure is controlled by the rotary motion of the backstops 180, which pivot below the insertion deck, allowing the stuffed envelope to be pushed out of the insertion area by the overhead pushers 132 with the assistance of the constant velocity vacuum deck belts 121, 123, 125. The stuffed envelope is subsequently held at nip 207 prior to passing through the intersection zone 208.

The control system 14 (see FIG. 1) ensures that all five envelopes move in unison, or perhaps slightly offset, in start/stop fashion and advance to the next staging area (i.e., LE location) within one cycle time. Once the stuffed envelope passes through the intersection zone 208, it is conveyed by an output belt 218 for subsequent mail finishing in the MOS.

Control logic and envelope motion profiles are engineered and paper (e.g., envelope) path lengths are tuned and finalized to a single fixed geometry to allow un-stuffed envelopes to pass vertically through the intersection zone 208 when an inserted envelope (i.e., horizontal motion) is not present in the zone. Similarly, stuffed envelopes pass horizontally through the insertion zone 208 when an un-stuffed envelope (i.e., vertical motion) is not present in the zone. Therefore, during steady state operation, un-stuffed and stuffed envelopes pass through the intersection zone 208 alternately without colliding. In order to accomplish this, the combined time of both a stuffed envelope and an un-stuffed envelope (with the maximum allowable flap length) in the intersection zone 208 should not exceed one machine cycle. Velocities, motion profiles, and paper path lengths are determined accordingly to guarantee this across a wide range of envelope sizes.

Figure 5:
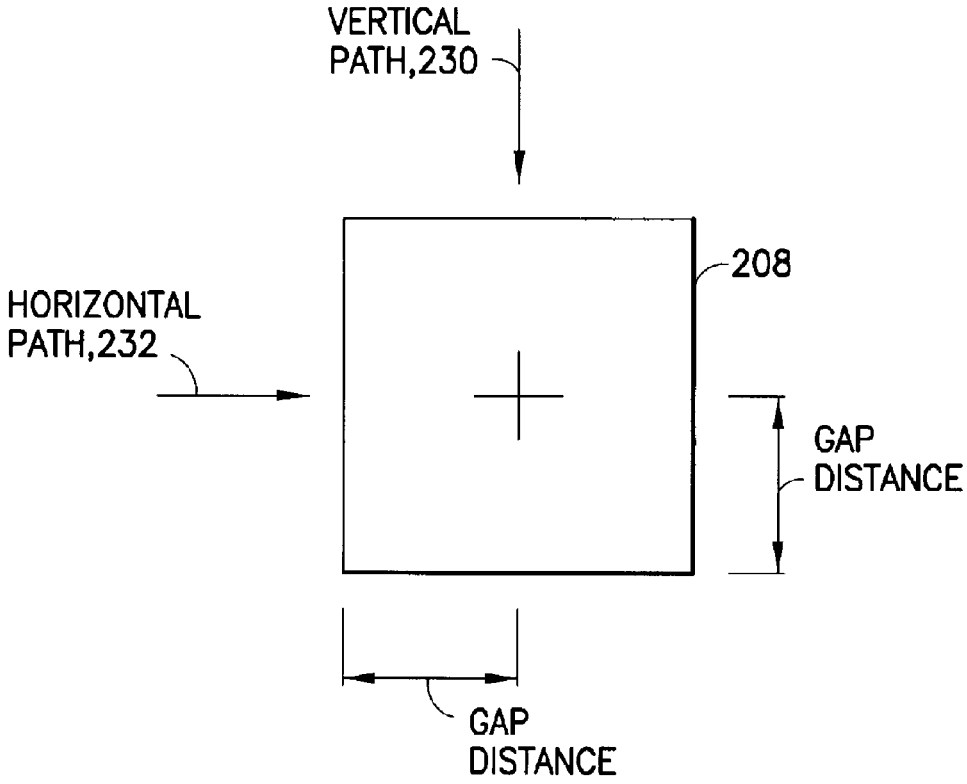
FIG. 5 is a schematic view of the intersection of the first feed path and the second feed path.

FIG. 5 illustrates a rule that was created to ensure a highly reliable intersection zone 208. The intersection zone 208 was established and timing was generated to ensure that no portion of two envelopes (stuffed and un-stuffed) are present in the intersection zone 208 simultaneously. In one embodiment, an intersection zone having a side dimension of approximately 2 inches was established to provide a large design margin in a motion control system, where maximum servo motion control errors typically do not exceed 1/16 of an inch. Intersection zones of other sizes may also be used.

The following table with the resulting cycle rates is an example for a wide range of envelope depths achieved without paper path velocities exceeding 125 inches/second or accelerations exceeding 8 g, where Tcycle is the period of a machine cycle in seconds.

| | Envelope Size | | | |
|---|---|---|---|---|
| | #10 | 6.5" × 9" | 10" × 13" | 12" × 9" |
| Envelope Depth (inches) | 4.125 | 6.5 | 10 | 12 |
| Cycle Rate (K/hour) | 22 | 18 | 13 | 11 |
| Max Flap (inches) | 2.56 | 2.56 | 2.56 | 2.56 |
| Tcycle (seconds) | 0.164 | 0.200 | 0.277 | 0.327 |

Embodiments of the invention may provide a system having the advantages of flap-up devices, such as a simple paper path and accessible envelope hopper, as well as the advantages of flap-down devices, such as reliability of inserting.

Embodiments of the invention may provide an apparatus having an envelope transport system comprising a first feed path 230 configured to transport an envelope 112 from an input at an envelope supply 200 to an insertion location 216, and a second feed path 232 configured to transport the envelope with an insert 130 therein from the insertion location 216 towards an output. The first and second feed paths intersect at the intersection zone 208, which is spaced from the insertion location 216. The paths 230, 232 are angled relative to each other at the intersection zone 208.

The first feed path 230 is substantially vertical at the intersection zone 208 and the second feed path 232 is substantially horizontal at the intersection zone 208. The first and second feed paths are angled relative to each other at the intersection at an angle of approximately 90 degrees. However, any suitable angle could be provided. The input from the envelope supply 200 is located vertically above the second feed path 232.

In the embodiment shown, as best seen in FIG. 3, the second feed path 232 is substantially straight. The first feed path 230 comprises a downstream redirection of the envelope of approximately 180 degrees. The first feed path also comprises at least one redirection of about 90 degrees located upstream from that redirection.

The first and second feed paths may be configured to transport the envelope substantially simultaneously with a second envelope. The controller 14 is connected to drives M1-M5 of the first and second feed paths. The controller, by controlling the drives M1-M5 and the backstops 180, is configured to allow only one envelope at a time in the intersection zone 208 proximate to the intersection.

Figure 6:
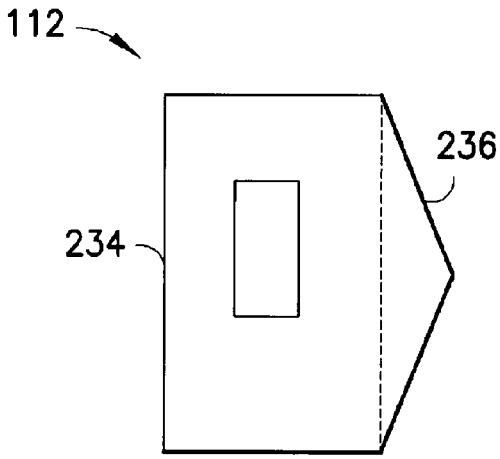
FIG. 6 is a top plan view of a top side of an envelope with the flap in an open position.

Referring also to FIG. 6, the first feed path is configured to transport the envelope from the input to the insertion location 216 with a closed end 234 of the envelope, which is located opposite a flap end 236 of the envelope, as a forward leading edge of the envelope, and to deliver the envelope at the insertion location 216 in a flap-down position to insert the mail piece insert into the envelope.

Embodiments of the invention may provide an apparatus comprising an envelope supply, an insertion station configured to insert a mail piece insert into an envelope while the envelope is in a flap-down position, and a transportation system configured to transport the envelope from the envelope supply to the insertion location 216 with a closed end 234 of the envelope 112, which is located opposite a flap end 236 of the envelope, as a forward leading edge of the envelope.

Figure 7:
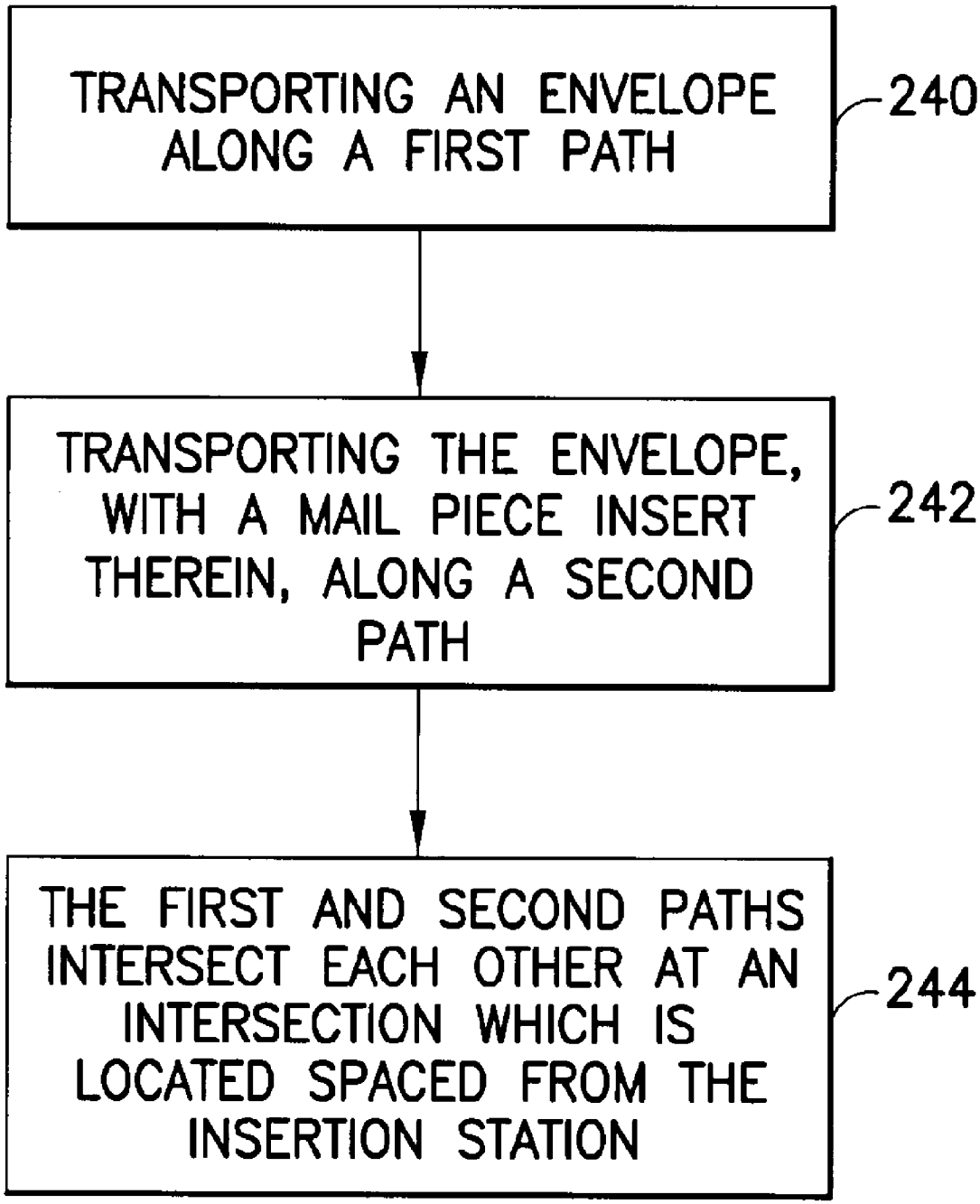
FIG. 7 is a diagram illustrating a method of the invention.

Referring also to FIG. 7, a method of the invention may comprise transporting an envelope along a first path from an input to an insertion location as indicated by block 240, and transporting the envelope with a mail piece insert therein along a second path from the insertion location to an output, as indicated by block 242. As indicated by block 244, the first and second paths intersect at an intersection that is spaced from the insertion location.

Referring also to FIG. 1, the invention may comprise a controller 14 having a memory 26 with software forming a program storage device tangibly embodying a program of instructions executable by a machine for performing operations as described above. For example, the operations may comprise transporting an envelope along a first path from an input to an insertion location, and transporting the envelope with a mail piece insert therein along a second path from the insertion location to an output, wherein the first and second paths intersect at an angle at a location spaced from the insertion location.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. An apparatus, comprising:

an envelope supply;

an insertion device configured to insert a mail piece insert into an envelope while the envelope is in a flap-down position in an insertion location; and a transportation system configured to transport the envelope from the envelope supply to the insertion location with a closed end of the envelope, which is located opposite a flap end of the envelope, as a forward leading edge of the envelope, wherein the transportation system comprises a first feed path from the envelope supply to the insertion location, and a second feed path from the insertion location to an output, and wherein the first feed path and the second feed path intersect downstream of the insertion location.

2. The apparatus of claim 1, wherein the envelope supply is vertically spaced from the insertion location.

3. The apparatus of claim 1, wherein the first feed path is substantially vertical at the intersection and the second feed path is substantially horizontal at the intersection.

4. The apparatus of claim 1, wherein the first feed path and the second feed path are angled relative to each other at the intersection at an angle of approximately 90 degrees.

5. The apparatus of claim 1, wherein the second feed path is substantially straight, and wherein the first feed path comprises a downstream redirection of approximately 180 degrees.

6. The apparatus of claim 5, wherein the first feed path comprises at least one redirection of approximately 90 degrees located upstream from the downstream redirection.

7. The apparatus of claim 1, wherein the first feed path and the second feed path are configured to transport the envelope substantially simultaneously with a second envelope, wherein the apparatus further comprises a controller connected to drives of the first feed path and the second feed path, and wherein the controller is configured to prevent the envelope from contacting the second envelope at the intersection.

8. The apparatus of claim 7, wherein the controller is configured to allow only one envelope at a time in an intersection zone proximate to the intersection.

9. A method, comprising:

transporting an envelope along a first feed path from an input to an insertion location; and transporting the envelope, with a mail piece insert therein, along a second feed path from the insertion location to an output, wherein the first feed path and the second feed path intersect downstream of the insertion location.

10. The method of claim 9, wherein the first feed path and the second feed path are angled relative to each other at the intersection at an angle of approximately 90 degrees.

11. The method of claim 9, wherein the first feed path redirects the envelope approximately 180 degrees.

12. The method of claim 9, wherein the envelope is transported along the first feed path with a closed end of the envelope, which is located opposite a flap end of the envelope, as a forward leading edge of the envelope, wherein the envelope is positioned at the insertion location in a flap-down position.

13. The method of claim 9, wherein the first feed path and the second feed path are configured to transport the envelope substantially simultaneously with a second envelope, wherein the first and second paths comprise multiple drive motors connected to a controller, the method further comprising controlling the drive motors to prevent the envelope from contacting the second envelope at the intersection.

14. The method of claim 13, wherein the drive motors are controlled to allow only one envelope at a time in an intersection zone proximate to the intersection.

* * * * *